US007247090B2

(12) United States Patent
Vacek

(10) Patent No.: US 7,247,090 B2
(45) Date of Patent: Jul. 24, 2007

(54) SYSTEM AND METHOD FOR INHIBITING MOISTURE AND MOLD IN AN OUTER WALL OF A STRUCTURE

(76) Inventor: Sam S. Vacek, 2502 Lake Gardens Ct., Humble, TX (US) 77339

( * ) Notice: Subject to any disclaimer, the term of this patent is extended or adjusted under 35 U.S.C. 154(b) by 513 days.

(21) Appl. No.: 10/006,635

(22) Filed: Nov. 8, 2001

(65) Prior Publication Data

US 2003/0084638 A1 May 8, 2003

(51) Int. Cl.
*F24F 7/08* (2006.01)
*F24F 7/10* (2006.01)

(52) U.S. Cl. ..... 454/186; 52/302.1; 52/302.3; 165/53; 165/54

(58) Field of Classification Search ..... 52/302.1, 52/481.1, 741.3; 454/271, 185, 186; 34/324, 34/444, 445, 446, 595, 138, 555
See application file for complete search history.

(56) References Cited

U.S. PATENT DOCUMENTS 1,443,986 A * 2/1923 Forcier ..... 52/199
2,264,961 A 12/1941 Ward ..... 20/4
2,641,449 A * 6/1953 Antony ..... 165/49
3,115,819 A * 12/1963 Mahlmeister et al. ..... 454/187
4,013,120 A * 3/1977 Rheinheimer ..... 165/48.1
4,072,187 A * 2/1978 Lodge ..... 165/48.1
4,506,595 A * 3/1985 Roberts et al. ..... 454/187
4,523,516 A * 6/1985 Foster et al. ..... 92/130 B
4,580,487 A * 4/1986 Sosnowski ..... 454/186
5,953,883 A * 9/1999 Ojala ..... 52/794.1
5,970,623 A * 10/1999 Tuggle ..... 34/134
5,988,264 A * 11/1999 Goldsmith ..... 165/48.1
6,108,991 A * 8/2000 Hagan et al. ..... 52/302.3
6,279,284 B1 * 8/2001 Moras ..... 52/408
6,293,120 B1 * 9/2001 Hashimoto ..... 62/260
6,319,115 B1 * 11/2001 Shingaki ..... 454/186
6,347,527 B1 * 2/2002 Bailey et al. ..... 62/238.7
6,484,417 B2 * 11/2002 Tedman et al. ..... 34/474
6,584,735 B2 * 7/2003 Burton ..... 52/95
6,705,939 B2 * 3/2004 Roff ..... 454/185
6,745,531 B1 * 6/2004 Egan ..... 52/302.1
6,754,997 B2 * 6/2004 Bonin ..... 52/220.1
6,843,718 B2 * 1/2005 Schmitz ..... 454/186
2002/0073628 A1 * 6/2002 Dextras ..... 52/1
2003/0207663 A1 * 11/2003 Roff ..... 454/186

OTHER PUBLICATIONS

Mechanical and Electrical Equipment for Buildings, Stein/Reynolds, 2000, John Wiley and Sons, Inc. 9, p. 382, 384, 424.*

* cited by examiner

*Primary Examiner*—Robert Canfield
(74) *Attorney, Agent, or Firm*—Madan, Mossman & Sriram, P.C.

(57) ABSTRACT

A structure comprises at least one outer wall having an internal wall section and an outer wall section with an air flow passage therebetween. A circulation system circulates air through the flow passage to inhibit moisture accumulation and mold growth. A sensing system determines the presence of moisture in the flow passage and generates a signal in response thereto. A controller receives the signal from the sensing system and controls the circulation system to maintain a predetermined temperature and relative humidity in the flow passage.

20 Claims, 5 Drawing Sheets

SYSTEM AND METHOD FOR INHIBITING MOISTURE AND MOLD IN AN OUTER WALL OF A STRUCTURE

BACKGROUND OF THE INVENTION

1. Field of the Invention

The present invention relates to a structure having an outer wall system, the construction of which provides for flow of air between an internal wall section and an external wall section for inhibiting moisture accumulation and mold growth on the internal wall section.

2. Description of the Related Art

In today's construction industry, numerous residential structures, and even a significant number of commercial structures such as, for example, apartment buildings, motels, restaurants, and strip shopping centers, have their exterior surfaces finished with a synthetic stucco-type coating applied over a foam insulation board. Such exterior finishes are generically referred to as Exterior Insulation and Finish Systems, and will be referred to hereinafter as EIFS.

While such EIFS constructions have proved to be quite satisfactory for their relative ease of installation, their insulating properties, and their ability to receive a variety of aesthetically-pleasing finishes, a serious problem associated with EIFS construction exists. This problem is one of moisture accumulation behind the exterior wall covering. As used herein, the term "moisture" refers to both liquid and airborne forms of water, including condensation. Such moisture may be the result of condensation or high humidity, but may also be the result of wind-driven water, that may enter behind the exterior wall covering at any point where the exterior surface of the coating is penetrated. Such moisture accumulation may be the result of poor workmanship or design, deterioration of flashing or sealants over time, lesser quality doors or windows, or any other penetration or compromise of the exterior finish.

When such water penetration, high humidity, or condensation occurs, absent effective, reliable means for eliminating the moisture from behind the EIFS exterior construction, the moisture can remain trapped long enough before evaporating to damage or rot any moisture-sensitive elements to which the insulation is bonded, typically wood framing, oriented-strand board, plywood, or gypsum sheathing. In addition, the moist environment is a breeding ground for wood consuming insects and health hazards such as various varieties of molds. This problem is accelerated in hot and humid environments.

Attempts have been made to prevent entry of moisture into the building wall interior by sealing or caulking entry points in and around wall components as the primary defense against moisture intrusion, or by installing flashing around the wall components to divert the moisture. These attempts have not been completely successful. Sealants are not only difficult to properly install, but tend to deteriorate and separate from the wall component or wall due to climatic conditions, building movement, the surface type, or chemical reactions. Flashing is also difficult to install and may tend to hold the moisture against the wall component, accelerating the decay.

The use of sealants and flashing is also limited to the attempted minimization of moisture collection in building walls in new construction, and the further collection in existing structures. These materials are of no value in addressing the problem of moisture that has already entered a building wall interior. Thus, with solutions presented in the prior art, moisture still enters the wall interior, and the problem is further compounded by the prevention of any evaporation of the moisture already in the wall interior.

The problems of moisture penetration and accumulation have prevented the full use of new building cladding materials, and has resulted in many buildings with rotting framing structures, requiring extensive and expensive retrofitting. Thus, there is a great need for an system and method to prevent moisture from accumulating in the wall interior of a building at wall components, and for the removal of moisture that has already collected within the wall interior.

SUMMARY OF THE INVENTION

The present invention contemplates a structure with an outer wall having an internal wall section and an external wall section with a flow passage in between. A circulation system flows air through the flow passage inhibiting moisture accumulation and mold growth.

In one embodiment, a structure system comprises at least one outer wall having an internal wall section and an external wall section, where the external wall section is located such that there is an air flow passage between the internal wall section and the external wall section. A circulation system circulates air through the air flow passage to inhibit moisture on the internal wall section.

In another preferred embodiment, an essentially enclosed structure system comprises at least one outer wall having an internal wall section and an external wall section, where the external wall section is located such that there is an air flow passage between the internal wall section and the external wall section. A circulation system circulates air through the air flow passage to inhibit moisture on the internal wall section.

At least one sensor generates a signal indicative of moisture and generates a signal in response thereto. A controller receives the signal from the at least one sensor and controls the circulation system to provide a predetermined relative humidity of the air flow in the air flow passage.

In one embodiment, a method is described for inhibiting moisture accumulation in an outer wall of a structure, comprising:

providing an outer wall with an internal wall section and an external wall section with an air flow passage therebetween; and supplying air into the flow passage by an air circulation system to inhibit moisture accumulation on the internal wall section.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF PREFERRED EMBODIMENTS

Figure 1:
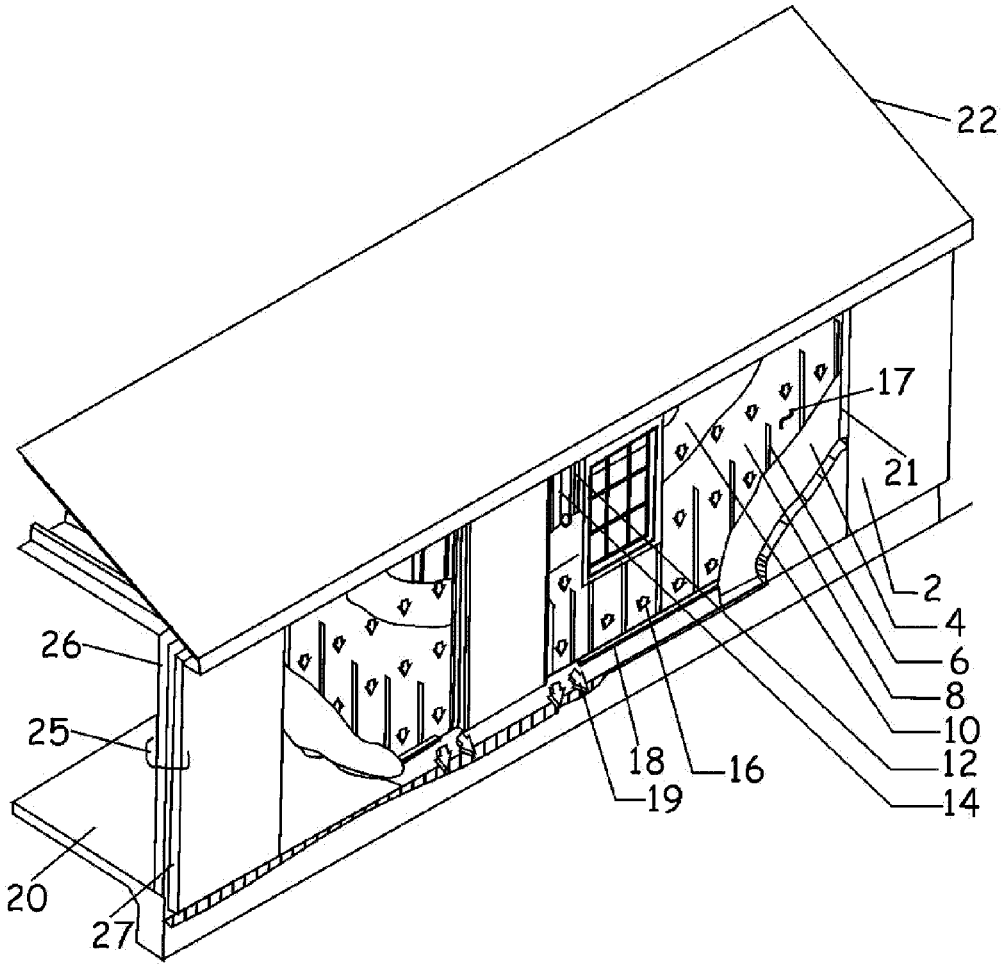
FIG. 1 is a perspective drawing of a structure according to one embodiment of the present invention.
Figure 2A:
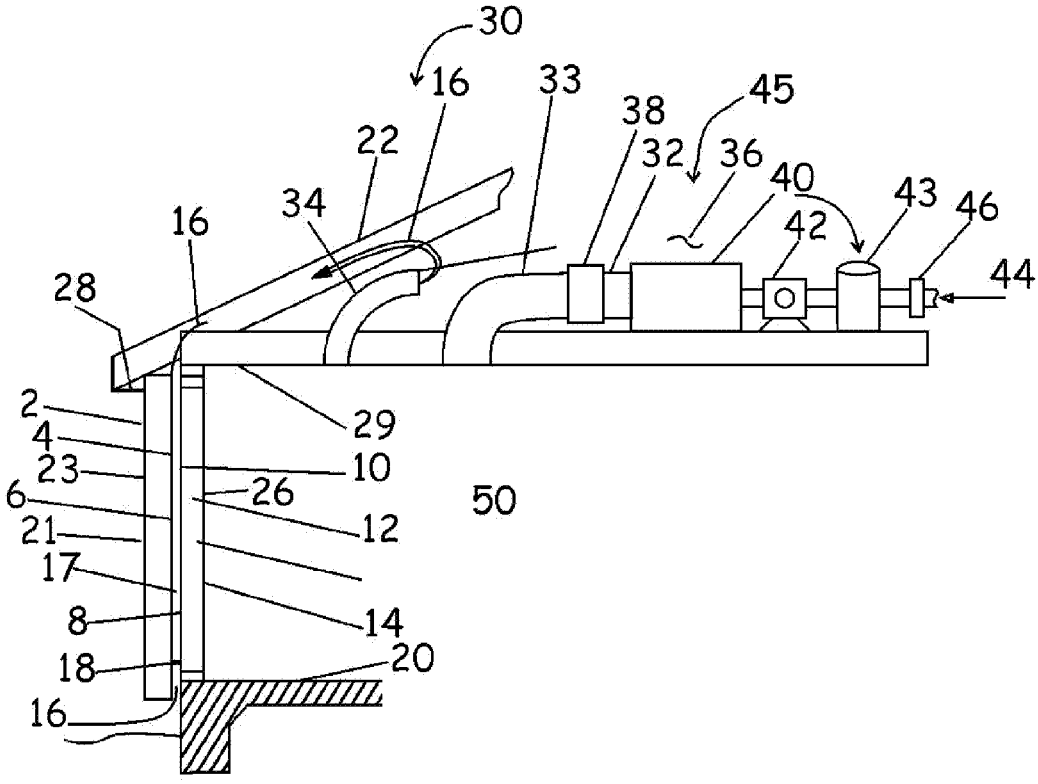
FIG. 2A and 2B are schematics of a structure according to one embodiment of the present invention.
Figure 2B:
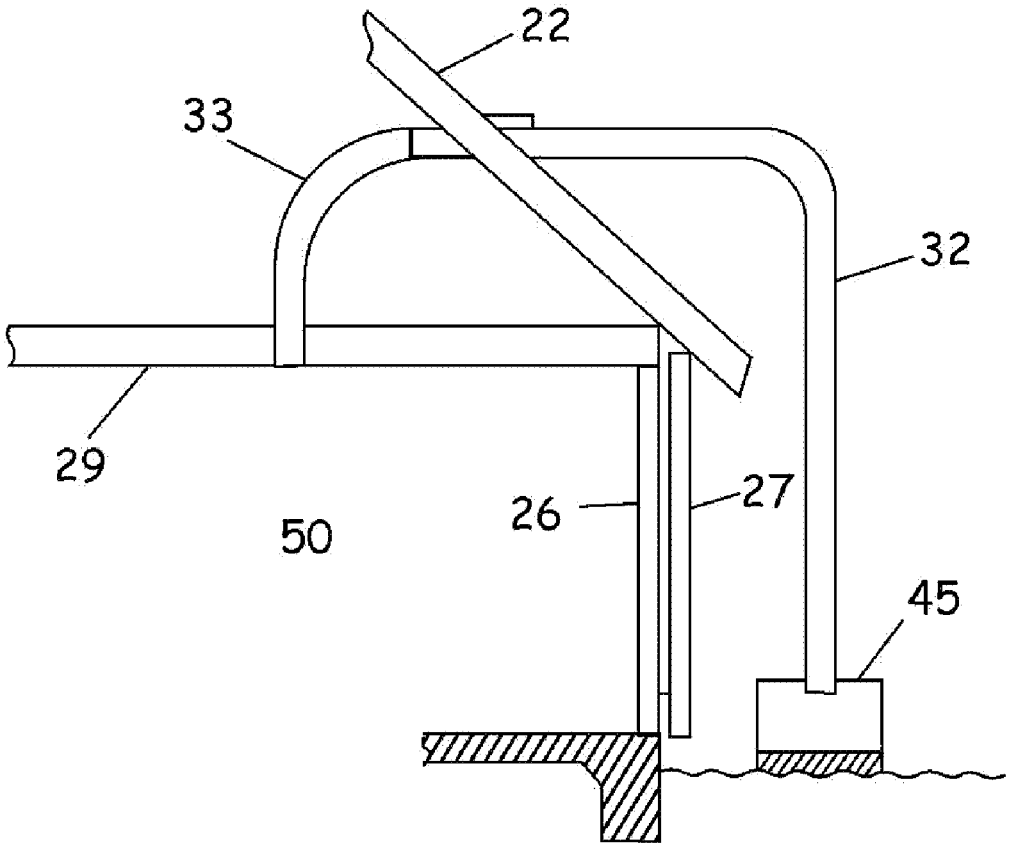

Referring to FIGS. 1, 2A and 2B, FIG. 1 shows a perspective view of a structure and FIGS. 2A and 2B show alternate sectional views of an outer wall 25 of a structure, and FIG. 2B shows an alternative sectional view of an outer wall of a structure according to certain embodiments of the present invention. The structure 30 comprises a foundation slab 20 having a dual section outer wall 25 attached thereto. The dual section outer wall 25 has an un-insulated internal wall section 26 and an insulated external wall section 27 displaced a distance away from internal wall section 26 such that an air flow passage 17 is established between them. Conditioned air 16 is forced out through the air passage 17 by the air circulation system 45 shown in FIG. 2 and described below, thereby inhibiting the accumulation of moisture and mold on the internal wall section 26.

The external wall section 27 is constructed with an exterior insulation and finish system, commonly referred to as EIFS, which comprises a weather resistant outer surface 2, typically of synthetic stucco, attached to a thermal insulating layer 21. Alternatively, any suitable weather resistant material may be used, including, but not limited to, brick tile, stone tile, wood siding, pressed board siding, and cementicious siding. The thermal insulating layer 21 is typically formed from an expanded polystyrene foam, but may alternatively be made from a polycyanurate or polyurethane foam, or from any suitable insulation material. The insulating layer 21 is, in turn, attached to a sheathing layer 4, typically a cementicious material known in the art. The external wall section 27 is attached to furring strips 6 which are in turn attached to the internal wall section 26 using attachment techniques known in the art. The furring strips 6 serve to establish the size of the flow passage 17 and to secure the outer wall section 27 to the inner wall section 26. Furring strips 6 can also be positioned to direct the flow of air 16 in the passage 17. The furring strips can be any suitable furring strips known in the art, with a "Z" shaped galvanized steel strip being preferred. Drain channel 18 is located near the bottom of passage 17 and is sloped to provide a drainage for any condensation or water which may need to be expelled from passage 17. Channel 18 may be solid and thereby used to direct the air flow 16 exiting from the passage 17 at a base of the outerwall to the outside environment, as shown by arrow 16. Alternatively, channel 18 may have multiple holes allowing moisture and air flow 16 to exit at the base of the exterior wall 25.

The inner wall section 26 comprises a commercially available liquid barrier 8 attached to an external sheathing 10 which is typically a commercially available plywood or oriented stranding board (OSB). The liquid barrier 8 prevents the passage of liquid water but allows for the passage of gases and water vapor and is well known in the art. The external sheathing 10 is attached to and supported by the framing studs 12. Any suitable framing stud material can be used including wood and metal materials. An interior sheathing 14 such as paneling, drywall board, or other suitable interior surface is attached to the interior side of the framing studs 12. The inner wall section 26, contrary to common construction, has minimal, or no insulation in its internal cavities. The lack of insulation minimizes the temperature gradient between the interior sheathing 14 and the external sheathing 10 in order to inhibit any condensation in the internal spaces of the inner wall section 26. The flow of appropriately conditioned air 16 through the flow passage 17 bordered by external sheathing 10 provides an air temperature at the external sheathing essentially the same as the air temperature inside the structure 30 thereby inhibiting condensation on the liquid barrier 8 or the sheathing 10.

As shown in FIG. 2, in a preferred embodiment, the circulation system 45 is located in an attic space 36 of structure 30. The attic 36 is bounded by roof 22 and ceiling 29. Roof 22 is connected to and essentially sealed with external wall section 27 by flashing 28 which extends around the periphery of structure 30. Conditioned air 16 from the circulation system 45 is forced through duct 33 into the interior 50 of structure 30. The air 16 exits the interior space 50 through a plurality of ceiling vents 34 which exhaust into the attic space 36. The attic space acts as a plenum for circulation system 45. Air enters the circulation system 45 through inlet damper 43 in attic 36 and outside makeup air 44 enters through makeup damper 46 and the combined intake air flows through blower 42 and into heating and cooling elements in conditioner 40, through duct 32 into humidifier 38 for maintaining a predetermined relative humidity. The heater elements (not shown), in conditioner 40 may be electric or gas type elements common in the art, or any other suitable heating elements. The cooling system (not shown) in conditioner 40 may be a conventional compresser/condenser type system. Alternatively, a heat pump system may be used for heating and cooling the air. Guidelines for selecting the predetermined relative humidity are available in published documents of The American Society of Heating, Refrigeration, and Air-Conditioning Engineers (ASHRAE), Standard 62-1999, Ventilation for Acceptable Indoor Air Quality, which indicates that the relative humidity should be maintained below about 70% to inhibit fungal contamination including, but not limited to, molds and mildew. The actual relative humidity and air flow requirements will be structure specific and are determined using procedures and standards known in the art.

The conditioned air flows through duct 33 and into interior space 50 and as previously described, exhausts through vents 34 into attic 36. The addition of the outside makeup air 44 to the air volume existing in the essentially sealed structure creates a suitable positive pressure in the structure 30 and attic 36 relative to the outside environment, and causes conditioned air to flow 16 through the air flow passage 17 in the outer wall 25. In a preferred embodiment, the blower 42 operates continuously forcing an essentially continuous flow of conditioned air 16 through the passage 17, thereby inhibiting the buildup of moisture and mold on the inner wall section 26.

The dampers 43 and 46 may be manually set to provide the appropriate flows. Alternatively, the dampers 43 and 46 may have actuators (not shown) which may be controlled remotely.

Figure 3:
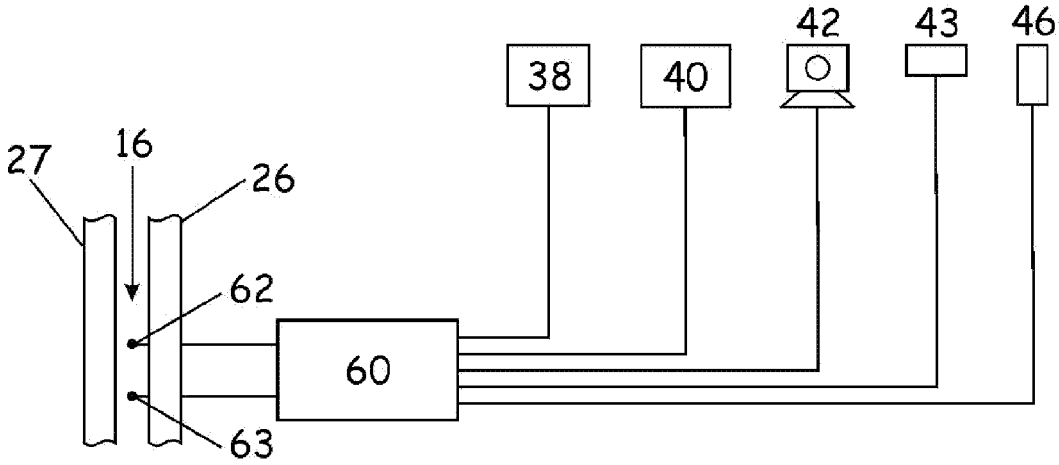
FIG. 3 is a block diagram of a circulation system according to one embodiment of the present invention.

In one preferred embodiment, see FIG. 3, temperature and relative humidity sensors 62 and 63 are disposed in passage 17 to measure the temperature and relative humidity of conditioned air flow 16. Signals from the sensors are received by a control system 60, which may contain sensor interface circuits, a processor, and output control circuits for actuating devices in the circulation system 45. As shown in FIG. 3, control system 60 receives signals from sensors 62 and 63 and acts according to programmed instructions to actuate makeup air damper 46, intake damper 43, blower 42, conditioner 40, and humidity controller 38 to maintain a predetermined temperature and relative humidity in conditioned air flow 16.

Figure 4:
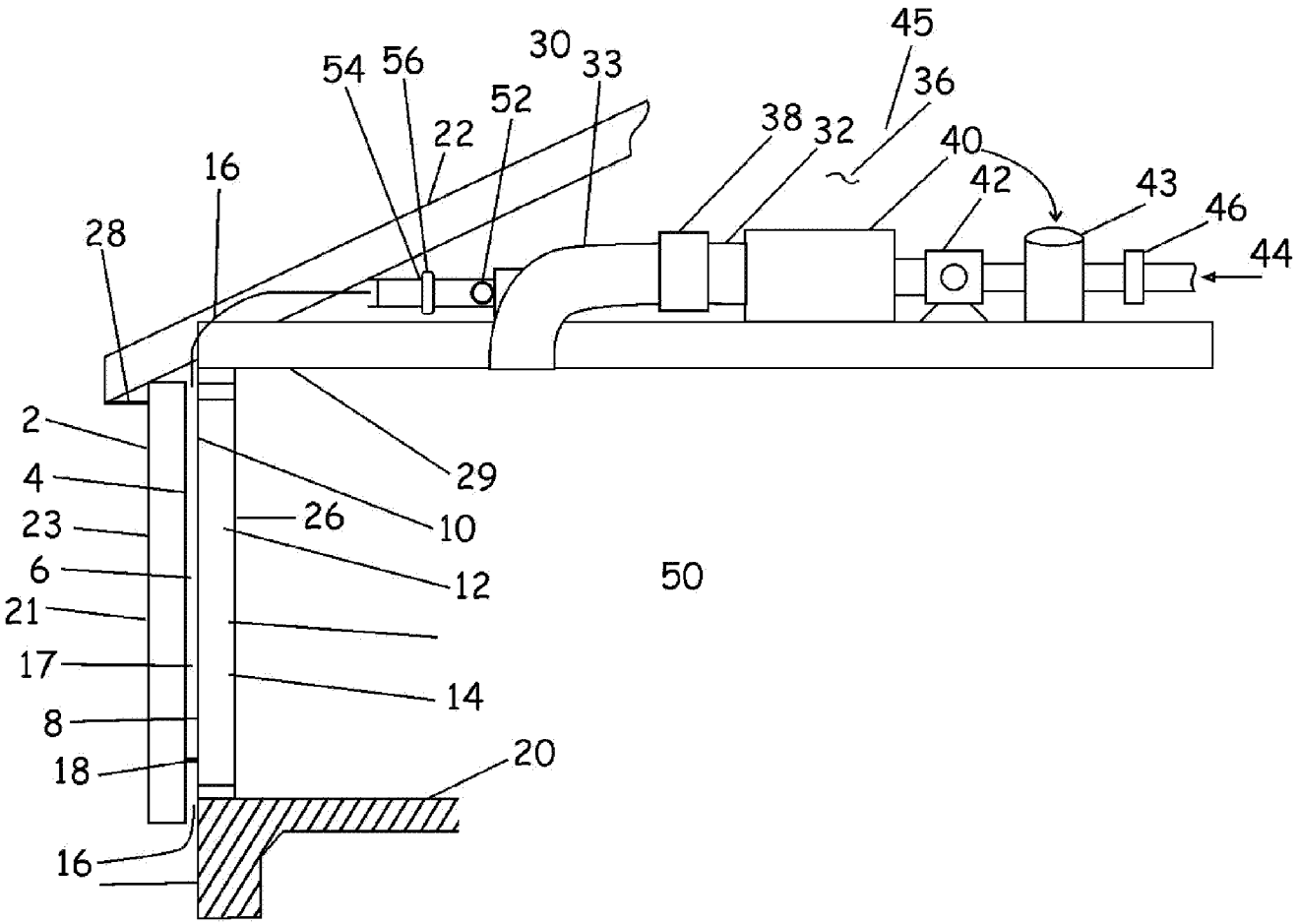
FIG. 4 is a schematic of a structure according to one embodiment of the present invention.

In another preferred embodiment, see FIG. 4, conditioned air is split from duct 33 and travels in header 52 around the periphery of the attic space 36. Multiple discharge ducts 54 direct conditioned air 16 from the header towards the opening of passage 17. The air flow is controlled by multiple dampers 56 on multiple discharge ducts 54. The dampers 56 may be manually set or, alternatively, may be fitted with actuators (not shown) which may be remotely controlled by control system 60.

In another preferred embodiment, a plurality of blowers (not shown) may be mounted so as to intake the conditioned attic air and discharge the air directly into the passage 17 at a plurality of predetermined locations around the perimeter of the structure. The passage of the discharged air passing between the furring strips 6 act to create a venturi effect to induce flow from between adjacent furring strips 6.

It will be appreciated by those skilled in the art, that the circulation system 45 may be wholly located external to the structure 30 with air flow to and from the structure 30 through suitable conduit or ducting (not shown). Alternatively, the circulation system 45 may be partially located in the structure 30 and partially located external to the structure 30 as is common in home systems. It is also to be understood that local environmental conditions and local building codes will, to some extent dictate the individual components used.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A structure comprising:

at least one outer wall, said outer wall further comprising:

an un-insulated internal wall section and an insulated external wall section, said internal wall section and said external wall section defining an air flow passage therebetween, said air flow passage channeling a conditioned air flow in-between and substantially parallel to said internal wall section and said external wall section and allowing the conditioned air to exit to an outside environment;

an open space adjacent the inner wall; and an air circulation system within the structure providing the conditioned air flow through the open space and into the air flow passage to inhibit moisture on the internal wall section, wherein the air circulation system creates a positive air pressure in at least a portion of the structure to cause at least some of said airflow to flow through the air flow passage, wherein the air circulation system comprises at least one of (i) a central mechanical air cooling device, (ii) a heating element, and (iii) a humidity control device, and wherein the air circulation system maintains the air temperature in the air flow passage at substantially the same temperature as the air in the open space.

2. The structure of claim 1 further comprising an attic that is in air communication with the air flow passage.

3. The structure of claim 1 further comprising a roof that is coupled to the external wall section to form an air seal therebetween.

4. The structure of claim 1 wherein the at least one outer wall includes a plurality of outer walls and a roof to form an enclosed structure.

5. The structure of claim 1 wherein the insulated external wall section comprises an insulating layer.

6. The structure of claim 5 wherein the external wall section further comprises:

a weather-resistant layer outside of the insulating layer; and a sheath inside of the insulating layer.

7. The structure of claim 1 wherein the internal wall section includes a liquid barrier.

8. The structure of claim 7 wherein the internal wall section further comprises a first sheathing between the liquid barrier and a wall framing system.

9. The structure of claim 1 further comprising a sensor chosen from the group consisting of: sensor providing a signal indicative of presence of moisture; and a sensor providing a signal indicative of temperature.

10. The structure of claim 9 wherein the at least one sensor is placed at one of (i) in the air flow passage; (ii) in an attic of the structure; (iii) adjacent to the air circulation system.

11. The structure of claim 9 further comprising a controller for controlling the air circulation system in response to the signal from the at least one sensor.

12. An enclosed structure comprising:

at least one outer wall that includes an un-insulated internal wall section and an insulated external wall section, said internal wall section and said external wall section defining an air flow passage therebetween said air flow passage channeling a conditioned air flow in-between and substantially parallel to said internal wall section and said external wall section and allowing the conditioned air to exit to an outside environment;

an open space adjacent the inner wall; and an air circulation system within the structure providing the conditioned air flow through the open space and into the air flow passage to inhibit moisture on the internal wall section, wherein the air circulation system creates a positive air pressure in at least a portion of the structure to cause at least some of said airflow to flow through the air flow passage, wherein the air circulation system comprises at least one of (i) a central mechanical air cooling device, (ii) a heating element, and (iii) a humidity control device; at least one sensor for generating a signal indicative of temperature in the air flow passage; and a controller for controlling said air circulation system in response to said signal from said at least one sensor to maintain the air temperature in to air flow passage at substantially to same temperature as the air in the open space to inhibit moisture on to internal wall section.

13. The enclosed structure of claim 12, further comprising a relative humidity sensor located proximate to the air flow passage for indicating to relative humidity of the air flow in said air flow passage.

14. The enclosed structure of claim 13, wherein the controller includes at least one circuit to interface with relative humidity sensor, and a processor, acting according to programmed instructions, to control to circulation system to provide a predetermined relative humidity of the air flow in said air flow passage.

15. A structure, comprising:

an inner space enclosed by at least one wall having an inner section and an outer section, the inner an outer sections defining an air flow passage therebetween that has a first opening for receiving air under pressure and a second opening for discharging the received air to an outside environment;

an air circulation system that supplies conditioned air under pressure to the inner enclosed space; and wherein the airflow passage receives the conditioned air from the inner enclosed space and discharges at least a portion of the received conditioned air under pressure to the the outside environment.

16. The structure of claim 15, further comprising a conduit that supplies the air received from the inner enclosed space to the air flow passage, wherein the conduit is one of: (i) a space in an attic over the inner enclosed space and the first opening or (ii); a passage that supplies the conditioned air from the inner space to the first opening.

17. A method for inhibiting moisture accumulation in an outer wall of a structure, comprising:

providing an outer wall having an un-insulated internal wall section and an insulated external wall section, said internal wall section and said external wall section forming an air flow passage therebetween, said air flow passage channeling a conditioned air flow in-between and substantially parallel to said internal wall section and said external wall section and allowing the conditioned air to exit to an outside environment; and supplying conditioned air at a positive pressure with an air circulation system through an open space adjacent the internal wall section and into the air flow passage to inhibit moisture accumulation on the internal wall section, wherein the air circulation system maintains the air temperature in the air flow passage at substantially the same temperature as the air in the open space, wherein the air circulation system comprises at least one of (i) a central mechanical air cooling device, (ii) a heating element, and (iii) a humidity control device.

18. The method of claim 17 further comprising determining relative humidity of the air inside the structure.

19. The method of claim 18 further comprising controlling supply of the air in response to the determined relative humidity.

20. The method of claim 18 further comprising controlling the air circulation system in accord to a programmed instruction provided to a controller associated with the air circulation system.

* * * * *